US008986763B2

(12) United States Patent
BenDavid

(10) Patent No.: US 8,986,763 B2
(45) Date of Patent: Mar. 24, 2015

(54) OPTIMAL EXTRACTION RATE COFFEE CAPSULE WITH EFFECTIVE SEAL FOR DIVERSE GROUP HEADS

(75) Inventor: Hanan BenDavid, Kfar Saba (IL)

(73) Assignee: Rialto Coffee Company Ltd., Jerusalem (IL)

( * ) Notice: Subject to any disclaimer, the term of this patent is extended or adjusted under 35 U.S.C. 154(b) by 116 days.

(21) Appl. No.: 13/526,579

(22) Filed: Jun. 19, 2012

(65) Prior Publication Data

US 2013/0224341 A1 Aug. 29, 2013

Related U.S. Application Data

(63) Continuation-in-part of application No. 13/405,409, filed on Feb. 27, 2012, now abandoned.

(51) Int. Cl.
*B65B 29/02* (2006.01)
*B65D 85/804* (2006.01)

(52) U.S. Cl.
CPC ..... *B65D 85/8043* (2013.01)
USPC ..... 426/77; 426/433; 99/295

(58) Field of Classification Search
CPC ..... B65D 85/804; B65D 85/8043; A47J 31/3623; A47J 31/3628; A47J 31/0678; A47J 31/0642; A47J 31/0668; A47J 31/0684; A47J 31/369
USPC ..... 99/298
See application file for complete search history.

(56) References Cited

U.S. PATENT DOCUMENTS

| | | | |
|---|---|---|---|
| 2008/0216666 | A1 | 9/2008 | Doglion |
| 2009/0223373 | A1 | 9/2009 | Kollep et al. |
| 2011/0041702 | A1 | 2/2011 | Yoakim et al. |
| 2011/0274794 | A1 | 11/2011 | Gerbaulet et al. |
| 2011/0297005 | A1 | 12/2011 | Marriler et al. |

FOREIGN PATENT DOCUMENTS

| | | | | |
|---|---|---|---|---|
| EP | 2489609 | | 8/2012 | |
| WO | WO 2010/084475 | * | 7/2010 | ..... A47J 31/36 |

* cited by examiner

*Primary Examiner* — Rena L Dye
*Assistant Examiner* — Chaim Smith
(74) *Attorney, Agent, or Firm* — Mark M. Friedman

(57) ABSTRACT

Coffee capsule for coupling with multiple group heads has a flange whose proximal end meets a bottom end of the side wall. A raised plateau adjacent a bottom end of the side wall may receive pressure from and form a fluid-tight seal against the group head together with the side wall. A proximal lip more radially distal than the first plateau higher than the first plateau may protrude from the top surface of the flange. The side wall may have a narrowed top section to avoid protrusions from the group head. A curved top may have a circumferential strip of reduced thickness for water inlet formation. A second plateau along the top surface of the flange more radially distal than the proximal lip may form a fluid-tight seal against a different group head. The capsule may be made of polypropylene copolymer TR-50 and preferably about 80% TR-50 to facilitate sealing.

20 Claims, 6 Drawing Sheets

OPTIMAL EXTRACTION RATE COFFEE CAPSULE WITH EFFECTIVE SEAL FOR DIVERSE GROUP HEADS

PRIORITY CLAIM

The present invention is a continuation-in-part nonprovisional patent application claiming the benefit of and priority to U.S. nonprovisional patent application Ser. No. 13/405,409 filed Feb. 27, 2012 by the same Applicant, which application is presently pending.

FIELD AND BACKGROUND OF THE INVENTION

The present invention relates to apparatuses and methods for capsules used in coffee-making making machines and, more particularly to such capsules for espresso designed for optimal extraction rate and usable in a diverse variety of group heads.

In the process of coffee preparation using a coffee-making machine, one step in the process is utilization of a capsule containing coffee granules. The coffee granules in the capsule are subjected to a flow of heated water. As the water flows through the capsule, it is hoped that the water is evenly distributed throughout the capsule. Furthermore, according to coffee baristas, there is an optimal extraction rate for espresso. Achieving the ideal extraction rate is an art. It has been found to be in the ballpark of 0.20, which means about a 20% solubility rate of the solute, namely the granules, in the solvent, namely the water.

There are two ways to make espresso. The first is to use a professional barista who, like a bartender, artfully mixes the ingredients over a relatively long amount of time to create the ideal espresso using a professional espresso-making machine. This is an art. The second way is to use an espresso-making machine that utilizes a coffee capsule. The advantage of making the espresso with a coffee capsule is that it is easier, cleaner and more standardized. The cost of the barista is also saved. The drawbacks include the fact that this method does not achieve as high a quality of espresso, whether measured by taste, flow or other subjective criteria. This outcome may be because when using the coffee capsule to make the espresso, the hot water is applied to the coffee granules for a very short time, as compared to the much longer period of exposure time when the professional barista makes espresso. Furthermore, the artistry and professional skill and experience of the barista is not available when using a coffee capsule.

A further technical problem with making espresso using a coffee capsule is ensuring that the coffee capsule that fits into the group head does not leak water and that the capsule does not get stuck in the group head. If the capsule does leak water, less coffee comes out of the brewing process and into the espresso. Furthermore, control is then lost over the exact percentage of water that should be present as an ingredient of the espresso and the optimal extraction rate cannot be achieved.

A further problem of making espresso using a coffee capsule is that a large manufacturer of coffee-making machines for espresso may have multiple types of group heads for their espresso making machines. For example, Societe Des Produits Nestle S.A. has several different group heads each having different structural characteristics and/or dimensions. Certain large manufacturers of coffee making machines deliberately make it difficult for coffee capsules not made by or for that manufacturer to be usable, for example so as to seal effectively, in the group heads of their machines. Furthermore, these manufacturers may it exceedingly difficult to create a coffee capsule that works in more than one of their group heads, and certainly not in all of them. This makes it impossible for a coffee capsule usable in one type of group head for one espresso making machine to be also usable in the group head of the other machines. Having to create separate coffee capsules for separate group heads significantly increases the manufacturer costs of espresso making.

Another technical problem is that the blades of the group head puncture the top of the coffee capsule. If the top of the coffee capsule is too soft, the puncture will not be easy and simple whereas if the coffee capsule is made from material that is too hard, it will be that much more difficult to achieve an effective seal against water leakage.

There is therefore a compelling need to have a method and/or apparatus for making espresso utilizing a coffee capsule (and hence enjoying all the advantages associated with the use of coffee capsules such as those mentioned above) without suffering from the drawbacks associated with making espresso using coffee capsules, such as the above-mentioned drawbacks and to thereby create espresso of the quality produced by professional baristas.

SUMMARY OF THE PRESENT INVENTION

One aspect of the present invention is a coffee capsule for coupling in sealing relation with a group head of a coffee-making machine, comprising a cup-like body portion including a side wall; a flange whose proximal end meets a bottom end of the side wall, the flange comprising a first plateau raised relative to a top surface of the flange, a proximal lip more radially distal than the first plateau and protruding from the top surface of the flange to a point higher than the first plateau, a second plateau along the top surface of the flange more radially distal than the proximal lip, the first plateau operative to be compressed by the group head and form a fluid-tight sealing engagement with the group head when the coffee capsule mates with the group head.

A further aspect of the present invention is a coffee capsule for coupling in sealing relation with a group head of a coffee-making machine, comprising a cup-like body portion including a side wall; a flange whose proximal end meets a bottom end of the side wall, the flange comprising a plateau raised relative to a top surface of the flange, the plateau situated adjacent the bottom end of the side wall, the plateau operative to be compressed by, and form a fluid-tight seal against, the group head A still further aspect of the present invention is a method of sealing a coffee capsule against group heads of more than one shape, the coffee capsule having a cup-like body portion and flange, the method comprising sealing the coffee capsule against a first group head by configuring a proximal end of the flange with a flexible first plateau, the first plateau raised relative to a top surface of the flange, so that the first group head presses against and forms a sealing engagement with the first plateau; separating the coffee capsule from the first group head; and sealing the coffee capsule against a second group head by configuring the flange with a second plateau more distal from a side wall of the coffee capsule than the first plateau, so that the second group head presses against and seals against the second plateau.

A yet still further aspect of the present invention is a coffee capsule for coupling in sealing relation with a group head of a coffee-making machine, comprising a cup-like body portion including a side wall; a flange whose proximal end meets a bottom end of the side wall, the flange comprising a first plateau raised relative to a top surface of the flange, the plateau situated adjacent the bottom end of the side wall.

Another aspect of the present invention is a coffee capsule for coupling in sealing relation with a group head of a coffee-making machine, comprising a cup-like body portion including a side wall; a flange whose proximal end meets a bottom end of the side wall, the flange comprising an open proximal chamber defined by at least two walls, the at least two walls include the bottom end of the side wall of the body portion and a bottom wall of the flange raised relative to a top surface of the flange, the bottom wall situated adjacent the bottom end of the side wall, the bottom wall operative to be compressed by, and form a fluid-tight seal against, the group head.

These and other features, aspects and advantages of the present invention will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

Figure 1:
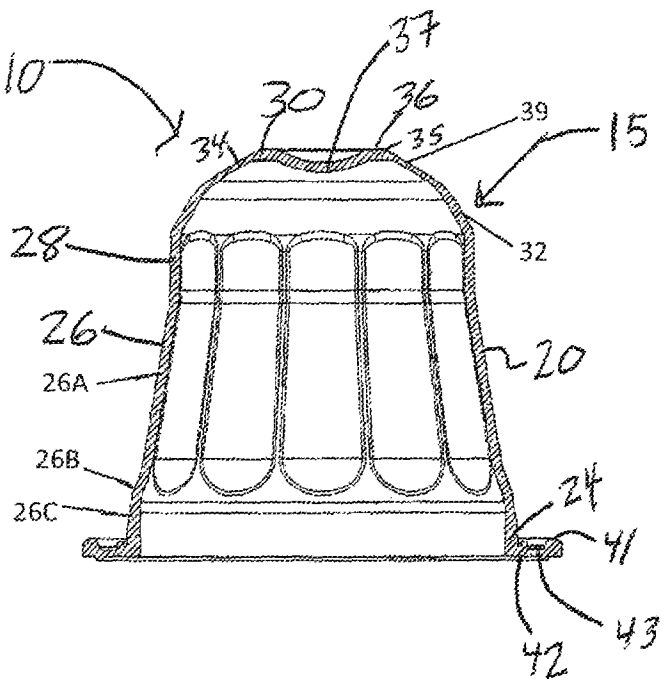
FIG. 1 is a vertical sectional view of a coffee capsule taken along line A-A of FIG. 6, in accordance with one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides a coffee capsule for placement in a group head of a coffee-making machine, and in particular in a machine for making espresso at an optimal extraction rate. The coffee capsule may have a cup-like body portion including a side wall, and a flange whose proximal end meets a bottom end of the side wall. The flange may comprise a first plateau raised relative to a top surface of the flange, a proximal lip more radially distal than the first plateau and protruding from the top surface of the flange to a point higher than the first plateau, and may include a second plateau along the top surface of the flange more radially distal than the proximal lip, the first plateau operative to receive pressure from and form a fluid-tight seal against the group head, preferably together with the side wall. The second plateau may seal against a second sized-shaped group head. The side wall may have a straight top section narrower than a main tapered section to avoid fins or other protrusions of the group head blocking coupling of the group head with the coffee capsule. The capsule may have a curved top meeting a top end of the side wall, the curved top may have a circumferential strip of reduced thickness for convenient puncturing by blades of the water head to define water inlets. The coffee capsule may be made of polypropylene copolymer comprising TR50.

In contrast to prior art coffee capsules, which may fit onto a group head of one particular espresso-making machine, the coffee capsule of the present invention may fit and seal effectively onto multiple types of group heads. For example the coffee capsule of the present invention may fit and seal effectively, without leakage of the pressurized water, onto the several types of group heads of espresso preparation machines of Societe Des Produits Nestle S.A. Furthermore, in contrast to coffee capsules for espresso making machines that may seal only with the existence of a separate gasket element, such as one made of silicone, which may come off from time to time, the coffee capsule of the present invention may achieve the effective seal referred to without the use of a separate gasket piece. Instead, the single integral unitary piece of material of the capsule itself (excluding the lid) may achieve this seal by its shape and by the material it is made from. In further contrast to the prior art coffee capsules, that may be made of aluminum, the coffee capsule of the present invention may be made of a polyproylene coplymer, for example one that comprises TR50 (and in some preferred embodiments about 80% TR-50 and about 20% R-50). As a result of one or more of the above structural and material characteristics and those listed below, the espresso may taste better, flow better and achieve the outcome and quality of espresso made by skilled baristas using a professional espresso-making machine. The present invention many thereby achieve the advantages of the professionally made espresso combined with the advantages of the method using capsules, without the disadvantages of each In contrast to prior art coffee capsules, in which the curved top of the capsule is of uniform thickness, the curved top of the coffee capsule of the present invention may have a circumferential strip of reduced thickness for optimal puncturing by the blades of the group head. For example, the thickness may be about 0.3 to about 0.45 mm instead of the thickness of about 0.5 to about 0.8 mm at the lower portion of the curved top of the capsule. In still further contrast to the prior art coffee capsules, wherein a protrusion on the surface of the flange may function as a sealing member to be compressed by the group head as the group head moves down onto it, and thereby form a fluid-tight seal against the group head, the flange of the coffee capsule of the present invention may utilize a plateau, for example a plateau adjacent the side wall of the capsule, that may be compressed by the group head and thereby form a fluid-tight seal against the group head, for example with the help of the side wall of the capsule. In contrast to certain prior art coffee capsules, the flange may have a proximal lip radially distal to the first plateau (sometimes called the plateau) and higher than the first plateau. In contrast to prior art capsules, the flange of the present capsule may include a second plateau configured to seal against a second type (i.e. size or shape) of group head of the same manufacturer that makes the first group head, the second plateau being radially distal to the proximal lip and to the first plateau. In yet still further contrast to the flange of prior art coffee capsules, the thickness of the flange of the coffee capsule of the present invention may be for example about 0.4 mm to about 0.7 mm and be suited for allowing the capsule to seal against multiple group heads of a manufacturer of espresso making machines. In contrast to prior art coffee capsules for espresso making machines, the side wall may have a straight narrow top section that may be configured so that the capsule is not blocked or impeded by a fin or other protrusion on certain types of group heads, for example a protrusion that may protrude horizontally. In contrast to some prior art coffee capsules, the capsule of the present invention may also not get stuck in the group head. In contrast to certain prior art coffee capsules, the capsule of the present invention may have a side wall having a main tapered section that may have a bulge positioned between more tapered and less tapered segments of the main tapered section, to allow the first group head to slide down the side wall of the capsule until the plateau, as the group head mates with the coffee capsule. In further contrast to the material of which prior art coffee capsules are made, which are either too hard for an effective seal with the group head, or too soft to allow easy and convenient puncturing by the blades of the group head, the coffee capsule of the present invention may be soft enough for an effective seal and hard enough for convenient and effective puncturing. This may be accomplished by utilizing TR-50 (and in some cases using about 80% TR-50 and about 20% R-50).

The principles and operation of a method and apparatus for an optimal extraction rate coffee capsule with effective seal for diverse group heads may be better understood with reference to the drawings and the accompanying description.

FIG. 1 is a vertical sectional view of the coffee capsule of the present invention, in accordance with one embodiment. FIG. 1 depicts a coffee capsule 10 for placement in a group head of a coffee-making machine, for example for espresso. The coffee capsule 10 may achieve an optimal extraction rate. As shown in FIG. 1, FIG. 3, FIG. 4 and FIG. 6, coffee capsule 10 may comprise a cup-like body portion 15 (FIG. 3) and a flange 40. The cup-like body portion 15 may define a hollow space. Body portion 15 may include a side wall 20, that may be a substantially circular side wall 20, whose top end 22 may meet a curved top 30. A bottom end 24 of side wall 20 may meet flange 40.

The curved top 30 may have a thicker lower portion 32, a thinner upper portion 34 comprising a circumferential strip, and a top portion 36. Although top portion 36 of curved top 30 may be generally flat, and may meet upper portion 34 at a corner 35, the overall appearance of curved top 30 is nonetheless generally curved. Top portion 36 may have a dimple 37 or depression at its center. The curved top 30, and in particular the upper portion 34, may be accessible, while positioned in the group head, for puncture to define water inlets.

Figure 2:
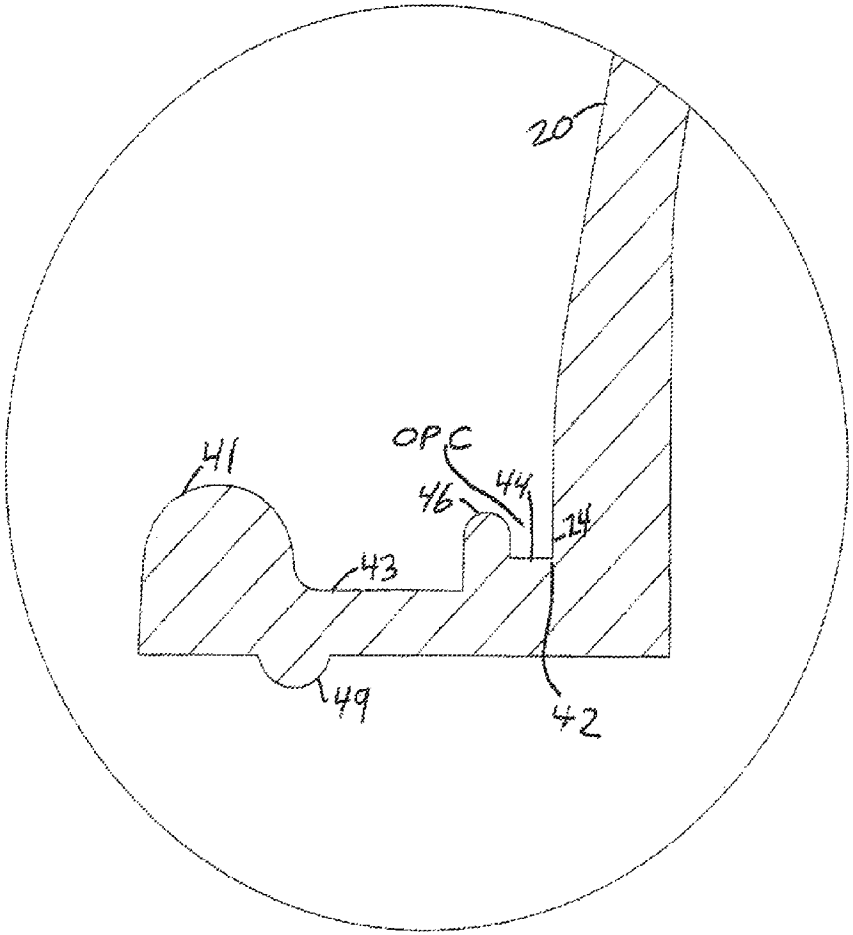
FIG. 2 is an enlarged sectional view of the flange and a portion of the side wall of the coffee capsule of FIG. 1, in accordance with one embodiment of the present invention.

As best appreciated from the enlarged sectional view of FIG. 2, flange 40 may have a proximal end 42 that may mate with a bottom end 24 of the side wall 20. Flange 40 may comprise a first plateau 44 (sometimes called "plateau", particularly when the second plateau is not being referred to) raised relative to a top surface 43 of the flange. First plateau 44, as shown in FIG. 2, may be adjacent a bottom end 24 of the side wall 20 of body portion 15.

In some preferred embodiments, flange 40 also has a proximal lip 46 more radially distal (from side wall 20) than the first plateau 44. Proximal lip 46 may protrude from the top surface 43 of flange 40 to a point higher than the first plateau 44. In the preferred embodiment shown in FIG. 2, proximal lip 46 is in the shape of a generally convex elevation.

As seen from FIG. 2, flange 40 may also comprise a second plateau 43 which is the top surface 43 of the flange 40 up to the distal lip 41. The second plateau 43 may be more radially distal than proximal lip 46 (in embodiments where proximal lip 46 appears) and more radially distal than first plateau 44. As seen from FIG. 2, second plateau 43 may be wider than first plateau 44. In some preferred embodiments, first plateau 44 may be less than half as wide as second plateau 43. An overall thickness of the flange 40, which is the perpendicular thickness of the flange at second plateau 43, may be between about 0.4 mm and about 0.6 mm—in some preferred embodiments this thickness is about 0.5 mm.

First plateau 44 may have a perpendicular height above the second plateau 43 of between about 0.2 mm and about 0.4 ram. In certain preferred embodiments, the first plateau has a perpendicular height above the second plateau of between about 0.2 mm and about 0.3 mm, and ideally abut 0.25 mm. An overall thickness of the flange 40 at the first plateau 44 (i.e. as measured from the first plateau 44 to the underside of the flange 40 directly (perpendicularly) below the first plateau 44) may be between about 0.6 mm and about 1.0 mm. In some preferred embodiments, the overall in thickness is between about 0.7 and about 0.8 mm.

Figure 2A:
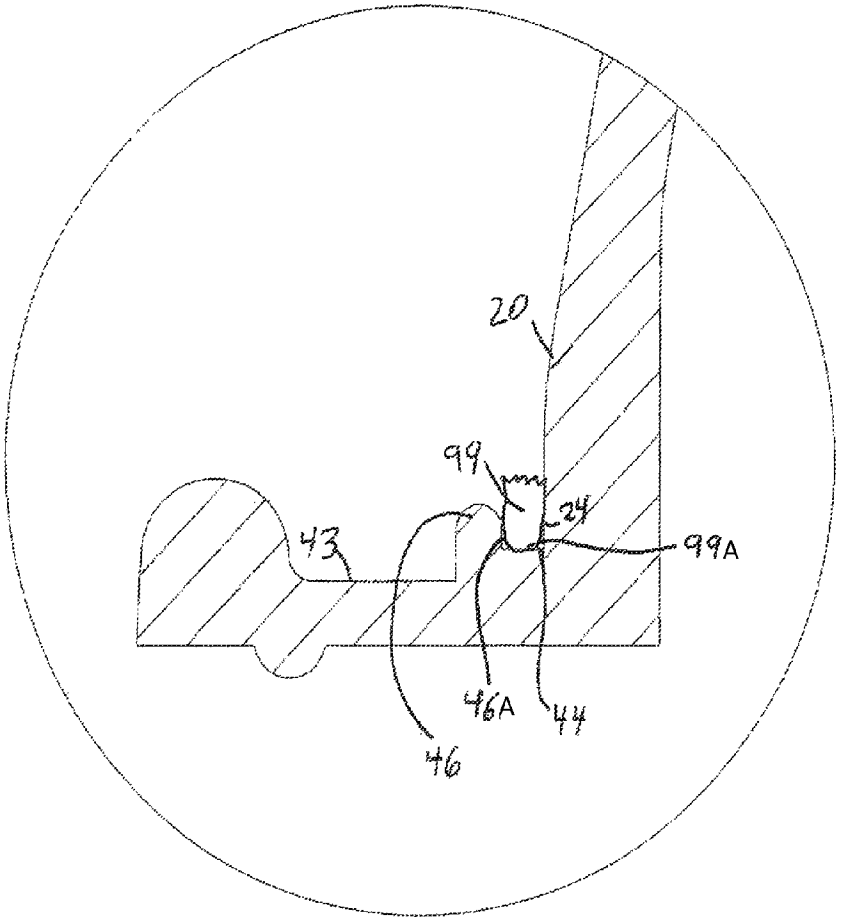
FIG. 2*a* is an enlarged sectional view of the flange and a portion of the side wall of the coffee capsule of FIG. 1 showing a fragmentary portion of a group head of an espresso-making machine sealing against the first plateau of the flange, in accordance with one embodiment of the present invention.
Figure 3:
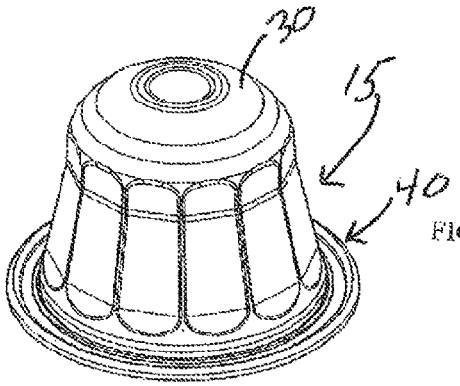
FIG. 3 is a perspective view of the coffee capsule of FIG. 1 from the top, in accordance with one embodiment of the present invention.
Figure 4:
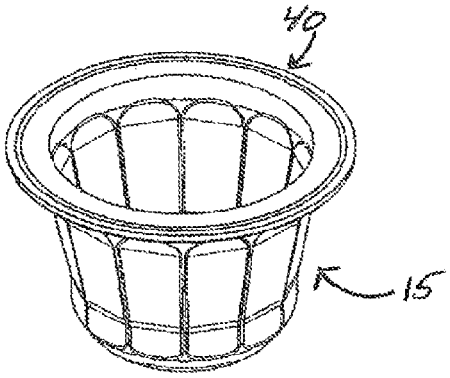
FIG. 4 is a perspective view of the coffee capsule of FIG. 1 from the bottom, in accordance with one embodiment of the present invention.

The first plateau 44 may be operative to deform and be compressed by the group head 99 and form a fluid-tight sealing engagement with the group head 99 (see FIG. 2*a*) that surrounds capsule 10 in the coffee-making machine when the group head and the coffee capsule are combined, i.e. mate, during operation of the coffee-making machine. Another way of stating this is that the group head 99 (FIG. 2*a*) may form a fluid-tight seal against first plateau 44. The fluid-tight seal or sealing engagement is typically a seal against pressurized water. The seal created by the fact that the group head 99 (FIG. 2*a*) may be operative to form the fluid-tight sealing engagement with the first plateau 44 may be further supported by side wall 20, and in particular may be further supported by a bottom end 24 of side wall 20, of cup-like body portion 15. Note that FIG. 2*a* is intended to show the sealing engagement functionally and is not intended to show the sealing engagement precisely. For example, the spaces appearing in FIG. 2*a* in the area of the seal should be ignored.

In a first preferred embodiment, as shown in FIG. 2, first plateau 44 does not have any protruberances. In a second embodiment, although entirely unnecessary for sealing engagement, first plateau 44 has one or more protruberances. Functionally, first plateau 44 does not require having any protruberances. However, if there are one or more protruberances, first plateau 44 would still be referred to as a plateau notwithstanding the fact that it would not be completely flat, since, for example, first plateau 44 may have one or more protruberances but still be comparatively level like a plateau.

In embodiments in which there is a proximal lip 46 protruding from flange 40, the group head 99 (FIG. 2*a*) may be said to form the sealing engagement with first plateau 44 surrounded by a chamber defined by first plateau 44, side wall 20 and proximal lip 46. However, it is the first plateau 44 that may deform and compress to effectuate the sealing engagement. The proximal lip 46 need not deform for the seal to be effective. Furthermore, in preferred embodiments, the proximal lip 46 does not in fact deform.

In some preferred embodiments, when group head 99 may mate with coffee capsule 10, the curved top 30 of capsule 10 may limit further downward movement of group head 99 over capsule 10. Accordingly, the height of first plateau 44 may be calculated with that in mind such that first plateau 44 may meet the end 99*a* of group head 99 to seal, as shown functionally in FIG. 2*a*. For example, the first plateau may be between 27.4 and 28.0 mm (and in some preferred embodiments may be between 27.6 mm and 27.7 mm) in perpendicular distance from a highest point of curved top 30 of body portion 15, as measured along an imaginary vertical axis of capsule 10 running through a center of capsule 10, which imaginary vertical axis is colinear with the cut line A-A shown in FIG. 6.

Generally, flange 40 may be a circular flange 40 projecting outward (generally perpendicularly from a top portion of the side wall 20) from bottom end 24 of side wall 20. Flange 40 may be configured so that its underside may mate with an outer portion of a lid (not shown). In some embodiments, flange 40 also has a distal lip 41. Distal lip 41 does not play a role in sealing but rather may be present to strengthen the flange 40. The dimensions of lip 41 are not critical. As can be seen from FIG. 2*a*, lip 41 may have a width that exceeds its height above surface 43. As seen in FIG. 2, flange 40 may also have on its underside a welding lip 49 that may be compressed by the lid (not shown) during attachment of the lid to the capsule. In some preferred embodiments, the welding lip 41 is about 1 mm wide and about 0.25 in height.

Another parameter that may contribute to the fluid-tight sealing engagement between first plateau 44 of capsule 10 and the group head 99 is the thickness of flange 40. The flange 40 at second plateau 43 may have a thickness of between about 0.4 mm and 0.7 mm. In some preferred embodiments, the thickness of flange 40 at the second plateau 43 may be between about 0.4 mm and about 0.6 mm, and in some preferred embodiment, about 0.5 mm. Proximal lip 46 may have a perpendicular height above the upper surface 43 of flange 40 (i.e. above second plateau 43) equal to between about 0.4 and about 0.8 mm. In some preferred embodiments, proximal lip 46 is about 0.6 mm above second plateau 43. The height of proximal lip 46 above first plateau 44 may not be critical and may be for example roughly equal to the width of proximal lip 46 (which is defined to be its width at its widest point) or in some preferred embodiments may be between 75 and 100 percent of the width of proximal lip 46. The height of proximal lip 46 above second plateau 43 (at the highest point of proximal lip 46) may not be critical and this height may for example be between 1.2 and 1.5 times (or between 1.1 and 1.5 in other embodiments) the width of proximal lip 46.

The material that coffee capsule 10 is made from may assist in creating the effective seal between the group head (whether this is first group head 99 or the second group head (not shown)) and the coffee capsule 10. Coffee capsule (without the lid) 10 may be formed of a plastic, for example a polypropylene copolymer plastic. The main copolymer may be a polyproylene material called TR50, which is somewhat flexible. Capsule 10 may comprise polypropylene copylmer TR-50. The present inventor has unexpectedly found that when TR-50 comprises about 80% of the copolymer and the other about 20% may be a harder polypropylene copolymer called R-50 in the polyproylene manufacturing industry, the coffee capsule 10 may be soft enough to allow the seal of the coffee capsule 10 with the group head to be very effective and enhanced yet hard enough to allow easy and effective puncturing of the curved top of the coffee capsule by the blades (not shown) of the group head 99. The full name of TR 50 and R 50 as known in the polypropylene manufacturing industry is CAPILENE® TR 50 and CAPILENE® R 50. These polypropylene polymers are manufactured by Bazan Group Carmel Olefins, an Israeli manufacturing company.

In order to make it easy for the blades (not shown) of the group head 99 to puncture the curved top 30 of capsule 10, a circumferential strip 39 of the curved top 30 may have a reduced thickness in an amount ranging from about 0.3 mm to about 0.45 mm. This thickness may be reduced in comparison to the thickness of the lower portion 32 of the curved top 30. As shown in FIG. 1, circumferential strip 39 may extend from a corner 35 of the curved top 30 toward side wall 30. Strip 39 may be at an angle to an axis perpendicular to flange 40. In some preferred embodiments, circumferential strip 39 may extend for about 6.7 mm, or a range of about 6 mm to about 8 mm along curved top 30 and in particular along the upper portion 34 of curved top 30.

The side wall may have a straight top section 28 narrower than a main tapered section 26. Straight narrowed top section 28 may be between 4 mm and about 5 mm long along the side wall 20. One purpose of narrowed straight top section 28 may be to avoid fins or other protrusions of the group head 99 impeding the coupling of the group head with the coffee capsule 10. Top section 28 may be straight in that it may be perpendicular or substantially perpendicular to and extending perpendicularly to flange 40. As shown in FIG. 1, along the main tapered section 26 the side wall 20 gradually may widen from where the main tapered section 26 meets the top section 28 until where the side wall 20 meets the plateau 44. As can be seen from FIG. 2, the main tapered section 26 has a more tapered segment 26*a* and a less tapered segment 26*b* with a bulge area 26*c* between the segments 26*a*, 26*b*. This bulge area or bulge 26*c* may facilitate a sliding of the group head 99 down side wall 20 up until the first plateau 44 during a coupling of the group head 99 with capsule 10 and sealing engagement between group head 99 and first plateau 44.

In some preferred embodiments, the perpendicular height of coffee capsule 10 from the underside of the flange 40 (without reference to any lid (not shown)) to a top surface 36 of the curved top 30 may be about 28 mm to about 29 mm. Although in a preferred embodiment the coffee capsule 10 of the present invention may be structurally suited for multiple types of group heads of a manufacturer of espresso-making machines, this feature and advantage is not a limitation unless expressly stated as a feature of a particular claim.

As shown in FIG. 2, the present invention may also be described as a coffee capsule for coupling in sealing relation with a group head of a coffee-making machine, comprising a cup-like body portion 15 including a side wall 20, a flange 40 whose proximal end 42 meets a bottom end 24 of the side wall 20, the flange 40 comprising an open proximal chamber ("OPC" in FIG. 2) defined by at least two walls, the at least two walls include the bottom end 24 of side wall 20 of body portion 15 and a bottom wall 44 of the flange 40 raised relative to a top surface 43 of flange 40, the bottom wall 44 situated adjacent the bottom end 24 of the side wall 20, the bottom wall 44 operative to be compressed by, and form a fluid-tight seal against, the group head 99. In some versions of this preferred embodiment, the open proximal chamber is also defined by a third wall 46*a* (see FIG. 2*a*) of proximal lip 46. Bottom wall 44 and side wall 20 of the body portion may meet at an angle of between about 70 degrees and 110 degrees to make the at least two walls of the open proximal chamber substantially perpendicular.

As can readily be seen from the preferred embodiment shown in FIG. 2, at least prior to being compressed or deformed by a group head 99, the bottom end 24 of side wall 20 of body portion 15 is substantially parallel to proximal side wall 46*a* (see FIG. 2*a*) of proximal lip 46 along at least at a portion of the proximal side wall 46*a* of proximal lip 46. As further seen from the preferred embodiment shown in FIG. 2, at least prior to being compressed or deformed by the group head, the first plateau 44 meets the bottom end 24 of side wall 20 at a substantially right angle (plus or minus 10%, which is nine rotational degrees) and meets the side wall 46*a* of the proximal lip 46 at a substantially right angle (plus or minus 10% which is nine rotational degrees).

Figure 6:
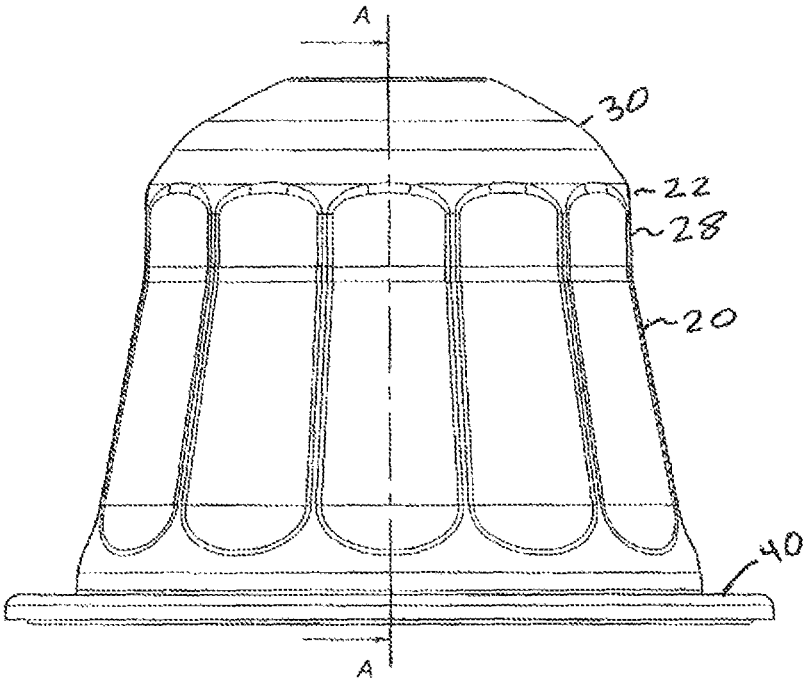
FIG. 6 shows a side view of the capsule of FIG. 1, in accordance with one embodiment of the present invention.

FIG. 6 shows a side view of the coffee capsule of FIG. 1. In some preferred embodiments, the coffee capsule 10 may be symmetrical such that front and rear views of the coffee capsule are identical and in some preferred embodiments the front and rear views may also be identical to the side view shown in FIG. 6.

Figure 5:
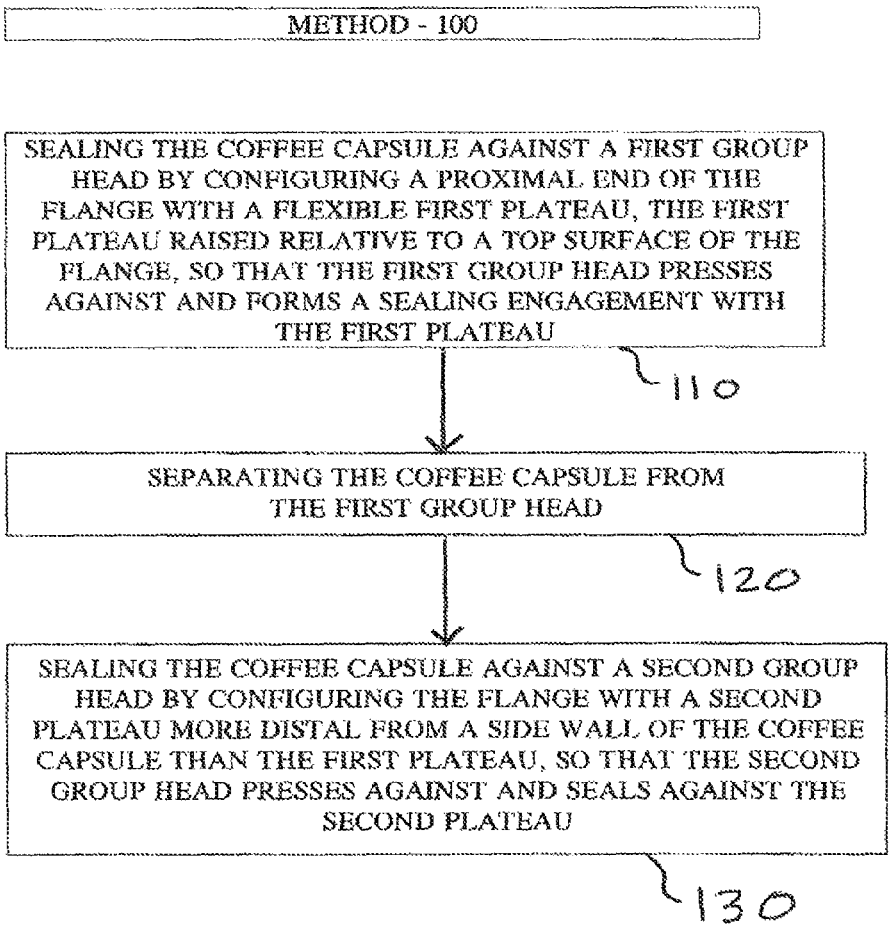
FIG. 5 is a flow chart showing a method of the present invention.

As shown in FIG. 5, the present invention may also be characterized as a method 100 of sealing a coffee capsule against group heads of more than one type where the coffee capsule has a cup-like body portion and a flange. The word "type" refers to a different shape or size of a group head. Typically, a different type of group head has a different structure, shape or dimensions for coupling to a coffee capsule and therefore a coffee capsule that couples with a sealing engagement with one type of group head would fail to couple with a sealing engagement with a second type of group head. However, the coffee capsule of the present invention may be capable of coupling with an effective sealing engagement with multiple types of group heads. For example, the coffee capsule of the present invention, in preferred embodiments, may couple with and form a sealing engagement with two different types, or in other preferred embodiments, with three different types, or in still other preferred embodiments, with four different types, or in still other preferred embodiments with five different types, of group heads of one particular manufacturer of espresso-making machines. The method may allow a coffee-making machine to brew espresso having an optimal extraction rate.

Method 100 may include a step 110 of sealing the coffee capsule against a first group head by configuring a proximal end of the flange 40 with a flexible first plateau 44, the plateau 44 raised relative to a top surface 43 of the flange 40, so that the first group head presses against and forms a sealing engagement with the first plateau 44.

A further step 120 may involve separating the coffee capsule from first group head 99 (FIG. 2*a*). Step 130 may comprise sealing the coffee capsule against a second group head (not shown) by configuring the flange 40 to have a second plateau 43 so that the second group head presses against the second plateau 43. The second plateau 43 may be distal from the side wall than the first plateau 44. The flange, in some preferred embodiments, may be configured so that the second plateau 43 is separated from the first plateau 44 by a proximal lip 46.

It should be understood that the term "second group head" used in this patent application means a second type of group head such that the second type is of a different shape and/or size than the first group head such that a coffee capsule that can couple with sealing engagement with one type of group head would not be able to do so with a second type of group head. The same is true of the term "third group head" which means a third type of group head different from the first and second types. The same applies to the fourth, fifth group heads. The same is also true of the term "different type" of group head, which should be understood to mean a different shape and/or size than the other type of group head such that a coffee capsule that can couple with sealing engagement with one type of group head would not be able to do so with a different type of group head.

Accordingly, one can see that method 100 may be expanded to also recite a step of separating the second group head from the coffee capsule and then coupling the coffee capsule to a third type of group head. One can further expand the method to then separating the coffee capsule again and further coupling the coffee capsule to a fourth type of group head, and then a fifth. Various permutations may be included. It may be, for example that the first, third and fifth types of group heads are configured to have the sealing engagement of the group head at the first plateau of the coffee capsule whereas the second and fourth types of group heads may seal at the second plateau. Any other permutation is contemplated. In some embodiments, the method 100 also comprises a step of configuring an upper part of a side wall of the body portion to have a straight narrowed top section extending perpendicularly, i.e. 90 degrees (or in some embodiments substantially perpendicularly + or −5% deviation from 90, or another tolerance such as 1%, 8%, 10%) toward the flange 40 to avoid fins projecting from the first group head from impeding or blocking a coupling of the coffee capsule with the first group head. The method 100 may also have a step of configuring the side wall with a tapered main section in which the side wall gradually widens until the side wall meets the plateau. In some embodiments, the method 100 may also comprise providing the side wall with a main tapered section that has a bulge 26*c* between a more tapered 26*a* and a less tapered segment 26*b* of the main tapered section 26 to facilitate a sliding of the first group head down the side wall 20 up until the first plateau during a coupling of the group head with the coffee capsule.

The preferred embodiments have been described separately. Not every detail of the structure of the capsule 10, for example, mentioned with respect to the apparatus embodiment has been repeated for the method embodiment 100. It should be understood, however, that these structural details, although not specifically enumerated in discussing the steps for the method embodiment, may also apply to this method embodiment.

In this patent application, the term "about", when applied to numerical quantities, mean plus or minus five percent of the numerical quantity.

Although the term group head is used throughout this patent application, it should be understood that the capsule 10 may be usable with beverage making machines other than espresso-making machines and that in that case, the "group head" may more broadly be referred to as an enclosing member, and the different group heads may then be referred to as the first enclosing member, second enclosing member, etc. Similarly, in that case, the term "coffee capsule" may more broadly be referred to as "capsule" 10.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A coffee capsule for coupling in sealing relation with a group head of a coffee-making machine, comprising:

a cup-like body portion including a side wall;

a flange whose proximal end meets a bottom end of the side wall, the flange comprising a first plateau and a second plateau, the first plateau situated adjacent the bottom end of the side wall such that, at least prior to deformation by a group head, a proximal end of the first plateau meets the bottom end of the side wall at a substantially perpendicular angle, the first plateau raised relative to a top surface of the flange, the flange also comprising a a proximal lip more radially distal than the first plateau and protruding from the top surface of the flange to a point higher than the first plateau, the second plateau along the top surface of the flange more radially distal than the proximal lip, the first plateau raised relative to a flat bottom surface of the second plateau, a space defined by a wall of the proximal lip, the first plateau and the bottom end of the side wall and that includes the substantially perpendicular angle, is dimensioned for receipt of a first group head such that a bottom surface of the first group head presses the first plateau, a first side of the first group head abuts the bottom end of the side wall and a further side of the first group head abuts the wall of the proximal lip, the area operative to be compressed by the group head and form a fluid-tight sealing engagement with the group head when the coffee capsule mates with the group head, the second plateau configured to receive a second group head when the first plateau does not engage the first group head, so as to seal the coffee capsule against the second group head when a bottom surface of the second group head presses against said second plateau, the second plateau dimensioned differently than the first plateau so as to receive the second group head, wherein the second group head is structured differently than the first group head.

2. The coffee capsule of claim 1, wherein a radial cross-section of the space is substantially rectangular.

3. The coffee capsule of claim 1, wherein the first plateau has a perpendicular height above the second plateau of between about 0.2 mm and about 0.4 mm.

4. The coffee capsule of claim 3, wherein the first plateau has a perpendicular height above the second plateau of between about 0.2 mm and about 0.3 mm.

5. The coffee capsule of claim 1, wherein an overall thickness of the flange at the first plateau is between about 0.6 ram and 1.0 mm.

6. The coffee capsule of claim 1, wherein a thickness of the flange at the second plateau is about 0.4 mm to about 0.7 mm.

7. The coffee capsule of claim 1, wherein the proximal lip is between about 0.4 mm and 0.8 mm raised in perpendicular height above the second plateau.

8. The coffee capsule of claim 1, wherein the second plateau is wider than the first plateau.

9. The coffee capsule of claim 1, wherein the first plateau is about 27.65 mm in perpendicular distance from a highest point of the coffee capsule.

10. The coffee capsule of claim 1, further comprising the coffee capsule formed of polypropylene copolymer comprising CAPILENE® TR50.

11. The coffee capsule of claim 10, wherein the copolymer is about 80% CAPILENE® TR50 and about 20% CAPILENE® R-50.

12. The coffee capsule of claim 1, further comprising the cup-like body portion also including a curved top, the side wall having a straight narrowed top section extending perpendicularly toward the flange and a main tapered section in which the side wall gradually widens from where the main tapered section meets the top section until where the side wall meets the plateau.

13. The coffee capsule of claim 12, further comprising the straight narrowed top section of the side wall extending between about 4 mm and about 5 mm.

14. The coffee capsule of claim 12, further comprising the curved top configured for puncture to define water inlets and including a circumferential strip having a thickness in an amount ranging from about 0.3 mm to about 0.45 mm, the thickness reduced in comparison to a thickness of the side wall.

15. The coffee capsule of claim 14, further comprising the thickness of the circumferential strip also reduced in comparison to a thickness of other parts of the curved top.

16. The coffee capsule of claim 1, further comprising a proximal lip more radially distal than the first plateau and protruding from the top surface of the flange to a point higher than the first plateau.

17. The coffee capsule of claim 16, further comprising a second plateau along the top surface of the flange more radially distal than the proximal lip.

18. A coffee capsule for coupling in sealing relation with a group head of a coffee-making machine, comprising:

a cup-like body portion including a side wall;

a flange whose proximal end meets a bottom end of the side wall, a proximal-most portion of the flange dimensioned to sealingly receive a bottom portion of group head of a coffee-making machine, the proximal-most portion of the flange comprising, at least prior to deformation by a group head, an angular three-sided annular chamber defined by three walls, the three walls include (i) the bottom end of the side wall of the body portion, (ii) a first plateau which is a bottom wall of the flange raised relative to a top surface of the flange, the first plateau situated adjacent and meeting the bottom end of the side wall at an angle of between 70 and 110 degrees, and (iii) a proximal side wall of a proximal lip, the proximal lip separating the first plateau from a second plateau of the flange, the first plateau meeting the side wall of the proximal lip at an angle of between 70 and 110 degrees, the bottom wall operative to be compressed by, and form a fluid-tight seal against, the group head.

19. The coffee capsule of claim 18, wherein the second plateau is configured to receive a bottom portion of a second group head when the first plateau does not engage the first group head, so as to seal the coffee capsule against the second group head when a bottom surface of the second group head presses against said second plateau, the second plateau dimensioned differently than the first plateau so as to receive the second group head, wherein the second group head is structured differently than the first group head.

20. The coffee capsule of claim 18, wherein the first plateau meets both the side wall of the proximal lip and the bottom end of the side wall of the body portion at respective angles that are within nine rotational degrees of being right angles.

* * * * *